US005419850A

United States Patent [19]

Backes et al.

[11] Patent Number: 5,419,850

[45] Date of Patent: May 30, 1995

[54] BLOCK DETERGENT CONTAINING NITRILOTRIACETIC ACID

[75] Inventors: Thomas W. Backes, Chesterfield; Sean D. Dingman, St. Louis; Sheldon P. Verrett, Olivette, all of Mo.

[73] Assignee: Monsanto Company, St. Louis, Mo.

[21] Appl. No.: 278,771

[22] Filed: Jul. 22, 1994

[51] Int. Cl.[6] ..... C11D 17/02; C11D 3/33

[52] U.S. Cl. ..... 252/174; 252/89.1; 252/90; 252/135; 252/136; 252/156; 252/174.14; 252/174.19; 252/527

[58] Field of Search ..... 252/135, 136, 527, 174, 252/174.14, 174.19, 89.1, 156, 90

[56] References Cited

U.S. PATENT DOCUMENTS 2,412,819 12/1946 MacMahon ..... 252/138
4,702,857 10/1987 Gosselink ..... 252/174.21
4,753,755 6/1988 Gansser ..... 252/527
4,911,856 3/1990 Lokkesmoe et al. ..... 252/95
5,205,960 4/1993 Kristopeit et al. ..... 252/174.24

FOREIGN PATENT DOCUMENTS 0003769 5/1979 European Pat. Off. ..... C11D 17/04
0203523 12/1986 European Pat. Off. ..... C11D 3/08

*Primary Examiner*—Christine Skane
*Assistant Examiner*—Gregory R. Delcotto
*Attorney, Agent, or Firm*—Lawrence L. Limpus

[57] ABSTRACT

A phosphate-free, solid, block detergent containing an alkali metal salt of nitrilotriacetic acid, an acid, alkali metal containing hydroxides and silicates, and alkali metal containing carbonates and sulfates is taught. A process for producing the block detergent is also taught.

34 Claims, No Drawings

BLOCK DETERGENT CONTAINING NITRILOTRIACETIC ACID

BACKGROUND OF THE INVENTION

This invention relates to solid detergent blocks. This invention further relates to solid detergent blocks which do not contain phosphate builders. More particularly, this invention relates to a solid block detergent produced from a salt of nitrilotriacetic acid and a method for preparing the solid block detergent.

DESCRIPTION OF THE PRIOR ART

In conventional institutional and industrial washing machines, detergents are added to the wash tank by means of automatic dispenser systems. These detergents generally have a high degree of alkalinity. Accordingly, they contain alkali metal hydroxides such as sodium hydroxide as well as chemicals that are particularly useful for hard surface cleaning. Examples of these include phosphates, silicates, chlorine-containing compounds, defoamers and organic polyelectrolyte polymers.

Solid detergents for machine washing were originally available in powder and granular forms. A serious problem with those forms of the detergent was the strong tendency of the material to cake or lump when it was exposed to small amounts of moisture or humidity. "Anticaking" agents were used; however, they were generally ineffective in the presence of larger amounts of moisture. The clumping or caking of the powder or granular detergent was avoided by producing the detergent in a block form.

Another major problem with automatic washing detergents is the inability of the detergents to be easily measured and dispensed. Solid block detergents provide a means whereby the safety, convenience and performance of the detergent and cleaning system can be enhanced. The use of solid, cast detergents minimizes contact between the user and the high performance or high alkalinity detergent composition. Additionally, the block detergents provide ease in installation and replacement.

One problem found in both solid, cast block detergent compositions and in powder detergent compositions is caused by the differing solubilities of the various components in water. The components of standard detergents dissolve at differing rates or have differing equilibrium solubilities, thus the first effluent from a solid, cast detergent may be rich in certain compounds while lacking in other key detergent compounds causing the effectiveness of the detergent to vary greatly through the wash cycle or from washing to washing.

U.S. Pat. No. 4,569,780 outlines a method for making solid, cast detergents in which an alkali metal hydroxide is heated to a temperature above its melt point and alkaline hydratable compounds, such as sodium tripolyphosphate present in an alkaline solution, are added to the melt.

U.S. Pat. No. 4,753,755 teaches a process for the production of a solid detergent. A hardness sequestering agent selected from the group consisting of alkali salts of nitrilotriacetic acid, phosphonic acid, glutonic acid, ethylene diamine tetraacetic acid or mixture thereof, which functions as a suitable substitute for sodium tripolyphosphate, is mixed into an aqueous solution containing alkali metal hydroxides, alkali metal silicates and mixtures thereof. Alkali metal salts of nitrilotriacetate such as sodium nitrilotriacetate and the like are preferred. An amount of a solid alkaline material is added to the dispersion to cause eventual solidification. However, the added solid alkaline material is required to be the same alkaline material as used to produce the aqueous solution, that is, alkali metal hydroxides, alkali metal silicates and mixtures thereof.

In addition to the desire to produce a more effective solid, cast block detergent for use in washing systems, there is a desire to reduce or eliminate the phosphate compounds present in effluent streams. Thus, there is a need for a solid, cast block detergent which does not contain a phosphate builder. There is also a need for a process for producing the solid, cast block detergent.

SUMMARY OF THE INVENTION

This invention is directed to a phosphate-free, solid, block detergent produced from an alkali metal salt of nitrilotriacetic acid. The solid, block detergent contains:

a. from about 5% to about 60% by weight of the formulation alkali metal salt of nitrilotriacetic acid;
b. from about 0.1% to about 10% by weight of the formulation acid;
c. from about 5% to about 40% by weight of the formulation of a first alkali metal containing compound selected from the group consisting of alkali metal hydroxides, alkali metal silicates and mixtures of alkali metal hydroxides and silicates, wherein when the alkali metal containing compound is an alkali metal hydroxide or a mixture containing an alkali metal hydroxide, the alkali metal containing compound must include from about 0.1% to about 20% by weight of the formulation potassium hydroxide; and
d. from about 5% to about 25% by weight of the formulation of a second alkali metal containing compound selected from the group consisting of alkali metal carbonates, alkali metal sulfates and mixtures of alkali metal carbonates and alkali metal sulfates.

This invention is also directed to a process for producing a phosphate-free, solid, block detergent from an alkali metal salt of nitrilotriacetic acid comprising the steps of:

a. preparing an aqueous alkaline solution containing from about 5% to about 40% by weight of the formulation of an alkali metal containing compound selected from the group consisting of alkali metal hydroxides, alkali metal silicates and mixtures of alkali metal hydroxides and silicates, wherein, when the aqueous alkaline solution contains alkali metal hydroxides, the alkali metal hydroxides must include from about 0.1% to about 20% by weight of the formulation potassium hydroxide;
b. mixing from about 5% to about 60% by weight of the formulation of an alkali metal salt of nitrilotriactetic acid into the aqueous alkaline solution to form a slurry;
c. adding from about 0.1% to about 10% by weight of the formulation of an acid to the slurry;
d. mixing from about 5% to about 25% by weight of the formulation of an alkali metal containing compound selected from the group consisting of alkali metal sulfates, alkali metal carbonates and mixtures of alkali metal sulfates and alkali metal carbonates into the slurry; and e. curing the slurry.

The acid is preferably sulfuric acid, but other acids such as, for example nitric acid, acetic acid and formic acid may be used. The slurry is preferably cured, or allowed to solidify, in a mold to provide the block with the desired shape.

DESCRIPTION OF THE PREFERRED EMBODIMENTS

In accordance with the present invention, there is provided a phosphate-free, solid, block detergent produced from an alkali metal salt of nitrilotriacetic acid. The solid, cast block detergent contains:

a. from about 5% to about 60% by weight of the formulation alkali metal salt of nitrilotriacetic acid;

b. from about 0.1% to about 10% by weight of the formulation acid;

c. from about 5% to about 40% by weight of the formulation of a first alkali metal containing compound selected from the group consisting of alkali metal hydroxides, alkali metal silicates and mixtures of alkali metal hydroxides and silicates, wherein when the alkali metal containing compound is an alkali metal hydroxide or a mixture containing an alkali metal hydroxide, the alkali metal containing compound must include from about 0.1% to about 20% by weight of the formulation potassium hydroxide; and d. from about 5% to about 25% by weight of the formulation of a second alkali metal containing compound selected from the group consisting of alkali metal carbonates, alkali metal sulfates and mixtures of alkali metal carbonates and alkali metal sulfates.

The solid, block detergent of this invention contains from about 5% to about 60%, preferably from about 25% to about 50% and more preferably about 35% to about 50%, by weight of the formulation of an alkali metal salt of nitrilotriacetic acid. Trisodium nitrilotriacetate monohydrate, sold commercially in powder form by Monsanto Company, is the preferred alkali metal salt of nitrilotriacetic acid, but other alkali metal salts of nitrilotriacetic acid may be used. The salt is a hardness sequestering agent in the formulation which is capable of sequestering hardness caused by the presence of ions such as magnesium, calcium and the like in the water used for washing. The trisodium nitrilotriacetate monohydrate does not contribute to the blocking process, that is, it does not absorb additional water, or absorbs only a very small amount, by hydration as generally required to form solid, block detergents. Thus, the inclusion of substantial amounts of the alkali metal salt of nitrilotriacetic acid in the formulation requires more efficient performance from the other components of the formulation as the other components must provide all of the hydration, the absorbtion of the water present into the solid crystals, that causes solidification of the slurry into a solid, block detergent.

The term "by weight of the formulation" used in this application means the amount or weight of the component "by weight based upon the total weight of the finished solid, block detergent."

The solid block detergent also contains from about 0.1% to about 10%, preferably from about 2% to about 8% and more preferably from about 3% to about 6%, by weight of the formulation acid. The acid is preferably sulfuric acid, but other mineral acids such as nitric acid and low molecular weight organic acids such as acetic acid and formic acid may be used. Sulfuric acid is preferred because it provides a strong neutralizing acid for the slurry and it forms a hydratable salt to improve the hardness of the resulting block detergent. When the acid is added to the slurry, a minor amount of heat is generated and cooling may be desired.

The addition of an acid to the formulation is in direct conflict with the processes generally used at the current time to produce solid block detergents. In the production of solid, block detergents, highly alkaline formulations are desired and the addition of an acid reduces the pH of the formulation, a reduction that must be overcome by other components of the formulation. However, in the process of this invention, the acid addition is an important step in the production of the desired solid block detergent. The acid partially neutralizes the alkali metal salts within the formulation, including the alkali metal salts of nitrilotriacetic acid, to contribute to the solidification of the block.

From about 5% to about 40%, and preferably from about 15% to about 30%, by weight of the formulation is an alkali metal containing compound selected from the group consisting of alkali metal hydroxides, alkali metal silicates and mixtures of alkali metal hydroxides and silicates. When the alkali metal containing compound is an alkali metal hydroxide or a mixture containing an alkali metal hydroxide, the alkali metal containing compound must include from about 0.1% to about 20%, and preferably from about 3% to about 8%, by weight of the formulation potassium hydroxide.

Sodium is the preferred alkali metal for both the hydroxides and the silicates, but other alkali metals may be used. Alkali metal silicates may be used in the production of the block detergent as set forth in this application without regard to the inclusion of other components in the formulation. However, when an alkali metal hydroxide such as sodium hydroxide, for example, which is frequently used in the preparation of block detergents, is included in the formulation, potassium hydroxide must also be included.

While Applicants are not bound by any theory by which the invention of this application operates, one possible explanation is that the inclusion of potassium containing compounds in the formulation may result in the formation of other salts containing combinations of the various cations in the mixture, specifically sodium, potassium and hydrogen. Some of these salts may be more capable of absorbing water by hydration than the original raw materials. One likely example of this would be the reaction of sodium carbonate and potassium hydroxide to form sodium potassium carbonate, which exists in the solid form as a hexahydrate. Another possible example could be the formation of mixed salts of the nitrilotriacetate such as a potassium sodium salt.

Based upon this theory and recognizing that the process of this invention includes the addition of potassium salts, sodium salts and an acid, it appears possible that both the rate and extent of solidification of the slurry may be controlled by controlling the ratio of the three cations in the slurry. Detergent blocks containing the three cations appear to have more desirable physical and performance characteristics. The blocks are harder, as all of the free water is consumed by hydration, and during use the blocks dissolve from the surface at a controlled rate without absorbtion of excess water and the resulting, undesired softening of the detergent block.

From about 5% to about 25%, and preferably from about 10% to about 20%, by weight of the formulation is an alkali metal containing compound selected from the group consisting of alkali metal carbonates, alkali metal sulfates and mixtures of alkali metal carbonates and alkali metal sulfates which act as blocking agents. The alkali metal carbonate, and more specifically sodium carbonate, is preferred. However alkali metal sulfates, preferably sodium sulfate, may also be used.

Today block detergent products are produced by mixing detergent ingredients to form a pourable slurry which hardens upon curing into a solid brick. Typical constituents in the machine washing blocks are alkalinity sources such as caustic, sodium silicate and sodium carbonate; a builder such as sodium tripolyphosphate; water; and a chlorine source such as sodium hypochlorite.

In the solid, block detergent of this invention, an alkali metal salt of nitrilotriacetic acid such as sodium nitrilotriacetate is used as the builder to produce a solid, cast block detergent which does not contain a phosphate builder. This detergent will eliminate, or at least reduce, the phosphate compounds present in effluent streams. Block detergents produced by this process also show no tendency to expand during curing or solidification which can be a problem with phosphate containing formulations.

This invention is also directed to a process for producing a phosphate-free, solid, cast block detergent. Detergent blocks are produced by mixing hydratable compounds with water to form a slurry which forms a block through the hydration of the component ingredients. In general terms the process includes the steps of (1) blending water with silicate and caustic compounds to produce an aqueous alkaline solution, (2) mixing an alkali metal salt of nitrilotriacetic acid into the aqueous alkaline solution to form a slurry, (3) adding an acid to the slurry, (4) mixing carbonate or sulfate compounds into the slurry, and (5) curing or solidifying the slurry in a mold.

More specifically this invention is directed to a process for producing a phosphate-free, solid, block detergent from an alkali metal salt of nitrilotriacetic acid comprising the steps of:

a. preparing an aqueous alkaline solution containing from about 5% to about 40%, and preferably from about 15% to about 30%, by weight of the formulation of a first alkali metal containing compound selected from the group consisting of alkali metal hydroxides, alkali metal silicates and mixtures of alkali metal hydroxides and silicates, wherein, when the aqueous alkaline solution contains alkali metal hydroxides, the alkali metal hydroxides must include sufficient potassium hydroxide to constitute from about 0.1% to about 20%, and preferably from about 3% to about 8%, by weight of the formulation;
b. mixing from about 5% to about 60%, preferably about 25% to about 50% and more preferably from about 35% to about 50%, by weight of the formulation of an alkali metal salt of nitrilotriactetic acid into the aqueous alkaline solution to form a slurry;
c. adding from about 0.1% to about 10%, preferably from about 2% to about 8% and more preferably from about 3% to about 6%, by weight of the formulation of an acid to the slurry;
d. mixing from about 5% to about 25%, and preferably from about 10% to about 20%, by weight of the formulation of a second alkali metal containing compound selected from the group consisting of alkali metal sulfates, alkali metal carbonates and mixtures of alkali metal sulfates and alkali metal carbonates into the slurry; and
e. curing the slurry.

The acid is preferably sulfuric acid, but other mineral acids such as nitric acid and low molecular weight organic acids such as acetic acid and formic acid may be used. Sulfuric acid is preferred because it provides a strong neutralizing acid for the slurry and it forms a hydratable salt to improve the hardness of the resulting block detergent. When the acid is added to the slurry, a minor amount of heat is generated and cooling may be desired. The slurry is preferably cured, or allowed to solidify, in a mold to provide the block with the desired shape.

Key considerations in the production of detergent blocks are the process rheology, cure times, and block expansion. The processing and product characteristics are controlled by the selection and concentrations of hydratable constituents. Variations in the composition of the formulation will cause differences in the cycle time, that is the time from the beginning of the process until a solid block detergent is formed. Variations in the composition of the formulation will also cause differences in the physical characteristics of the slurry, particularly the handling characteristics, and in properties of the block detergent such as the hardness and solubility.

This invention requires the use of an alkali metal salt of nitrilotriacetic acid, which is preferably the sodium salt, and an acid, which is preferably sulfuric acid. These two components of the formulation may be added by two separate steps in the process, as discussed above, in which the alkali metal salt of nitrilotriacetic acid is the preferred trisodium nitrilotriacetate monohydrate, sold commercially in powder form by Monsanto Company, and the acid is the preferred sulfuric acid.

Alternatively, the alkali metal salt of nitrilotriacetic acid and the acid can be added to the process together in one process step in the form of an acid treated alkali metal salt of nitrilotriactetic acid. The acid treated alkali metal salt of nitrilotriacetic acid forms a solid, granular product which can replace the trisodium nitrilotriacetate monohydrate powder and acid in the process and eliminate one process step.

One process for the production of the granular, acid treated alkali metal salt of nitrilotriactetic acid produces granular alkali metal nitrilotriacetate having a density of from about 0.70 g/cc to about 0.81 g/cc and absorptivity of surfactant in the range of from about 12 to 14 ml/100 g. The process comprises the steps of (1) contacting trisodium nitrilotriacetate monohydrate powder with an aqueous solution containing from about 35% to about 60%, by weight, sulfuric acid; (2) mixing the wetted trisodium nitrilotriacetate monohydrate powder providing an acid addition time/mixing time ratio in the range of above about 0.75 to about 1; and (3) drying the granules.

When the granular, acid treated alkali metal salt of nitrilotriactetic acid is used in the process of this invention to produce a phosphate-free, solid, block detergent from an alkali metal salt of nitrilotriacetic acid, the acid addition step is deleted and the process comprises the steps of:

a. preparing an aqueous alkaline solution containing from about 5% to about 40%, and preferably from about 15% to about 30%, by weight of the formulation of an alkali metal containing compound selected from the group consisting of alkali metal hydroxides, alkali metal silicates and mixtures of alkali metal hydroxides and silicates, wherein, when the aqueous alkaline solution contains alkali metal hydroxides, the alkali metal hydroxides must include from about 0.1% to about 20%, and preferably from about 3% to about 8%, by weight of the formulation potassium hydroxide;

b. mixing from about 5% to about 60%, preferably about 25% to about 50% and more preferably from about 35% to about 50%, by weight of the formulation of a granular, acid treated alkali metal salt of nitrilotriactetic acid into the aqueous alkaline solution to form a slurry;

c. mixing from about 5% to about 25%, and preferably from about 10% to about 20%, by weight of the formulation of a blocking agent selected from the group consisting of alkali metal sulfates, alkali metal carbonates and mixtures of alkali metal sulfates and alkali metal carbonates into the slurry; and d. curing the slurry.

Free hydroxide ions, provided as an alkali metal salt which is preferably sodium hydroxide and potassium hydroxide, are used to saponify soils and to cut greases rapidly in industrial and institutional cleaners. Increased levels are often used in applications with routine heavy soil loadings. These hydroxides can be used in block detergents in either anhydrous or solution forms. Use of the solution form of the hydroxide reduces temperature exotherms associated with the heats of solution and hydration.

Silicates such as sodium silicates are added to block detergents to provide improved corrosion protection for overglaze, glassware and soft metal applications. The silicates provide an alkalinity source and also improve fluidity during the pour cycle. Sodium metasilicates and liquid silicates such as RU® Silicate (SiO2/-Na20 ratio=2.4) provided by PQ Corporation are typically used in formulations.

Sodium carbonate (soda ash) finds widespread use in detergent products as a low-cost alkalinity source. In detergent blocks, anhydrous sodium carbonate is used to bind water through hydration.

Surfactants should be selected for a low foaming profile as they act as a defoamer for food oils, help the caustic to wet and assist in the final rinsing of the caustic. In highly built detergent blocks, physical separation of surfactants from the process mixture is another important consideration. The surfactants typically used in block detergents are ethoxylated propoxylated block copolymers such as Polytergent SLF-18® produced by Olin Corporation and Plurafac RA-25® produced by BASF Corporation. Other well known surfactants include alcohol alkoxylates, alkyl aryl alkoxylates, alkylene oxide adducts of hydrophobic bases and alkoxylates of linear aliphatic alcohols. Surfactant concentrations are generally less than 2% in the block.

Deionized water is recommended for use in block detergent manufacture to maximize the total builder or hardness ion control capability in the end use. Water which contains calcium or magnesium ions can result in increased cure times.

Sodium sulfate is sometimes used in block detergent formulations as a filler and processing aid.

There are other compounds which may be added to the formulation, if desired, including polymeric electrolytes such as polyacrylates which are anti-redeposition or anti-spotting agents, agents to reduce mineral deposits in the equipment, dyes, fragrances, and non-chlorinated bleaching agents such as sodium perborates and peroxide bleaches.

The process of this invention takes place at or near ambient temperature, between 20° C. and 40° C. During the addition of the acid to the slurry, a minor amount of heat may be generated and cooling may be desired, but it is not required. No outside heating source is required for the mixing of the components or for the curing or solidification of the slurry into the block detergent.

Mixing equipment should be selected which accommodates the physical transition from thin liquids to pasty slurries. Viscosities of the processed materials range from a few centipoise during the early process steps to a few thousand centipoise when the slurry is ready for curing or solidification in a mold. Thus mixers such as a Hobart mixer or a high intensity anchor type proximity agitation system should be considered.

This invention will be explained in detail in accordance with the examples below, which are for illustrative purposes only and shall not limit the present invention.

EXAMPLE I

A mixture of 16 grams of deionized water, two grams of a low foam anionic surfactant, alkylated diphenyl oxide disulfate (Dowfax 3B2® from Dow Chemical Company), and 29 grams of a 47% solution of sodium silicate with a $SiO_2/Na_2O$ ratio of 2.40 (RU® Sodium Silicate from PQ Corporation) was stirred in a 250 milliliter slurry cup for 5 minutes. To the mixture were added 25 grams of hydratable, granular sodium nitrilotriacetic acid, produced by agglomerating trisodium nitrilotriacetate with aqueous sulfuric acid and drying, and 28 grams of sodium carbonate. The slurry was mixed for 10 minutes and poured into a hexagonal mold. The slurry formed a solid, cast detergent in about 2 hours.

EXAMPLE II

A mixture of 10 grams of deionized water, two grams of a low foam alcohol ethoxylate surfactant (Tergitol 15-S-9® from Union Carbide Corporation), 20 grams of a 47% solution of sodium silicate with a $SiO_2/Na_2O$ ratio of 2.40 (RU® Sodium Silicate from PQ Corporation) and 10 grams of a 50% solution of sodium hydroxide was stirred in a 250 milliliter slurry cup for 5 minutes. The solids, 43 grams of hydratable, granular sodium nitrilotriacetic acid and 15 grams of sodium carbonate, were blended prior to their addition to the mixture. The blended solids were gradually added to the liquid mixture while increasing the mechanical stirring to a maximum of 500 rpm. The slurry was stirred for 5 minutes and poured into a hexagonal mold. The slurry formed a solid, cast detergent in about 6 hours.

EXAMPLE III

A mixture of 30 grams of deionized water, 2 grams of a low foam anionic surfactant, alkylated diphenyl oxide disulfonate (Dowfax 3B2® from Dow Chemical Company) and 20 grams of a 47% solution of sodium silicate with a $SiO_2/Na_2O$ ratio of 2.40 (RU® Sodium Silicate from PQ Corporation) was stirred in a 250 milliliter beaker, forming a clear solution. A slurry was formed by adding 33 grams of granulated sodium nitrilotriacetate to the solution. The granulated nitrilotriacetate was produced by agglomerating trisodium nitrilotriacetate with aqueous sulfuric acid and drying. The slurry was mixed for approximately 2 minutes to achieve uniformity and 15 grams of sodium carbonate were then added. This final slurry was mixed for approximately 5 minutes, after which it was poured into a mold. The slurry solidified over a period of a few hours, producing a block that was sufficiently solid to be removed from the mold. The surface of the block was dry and yielded only slightly to attempts to deform it with thumb pressure.

EXAMPLE IV

A mixture of 2 grams of a low foam anionic surfactant, alkylated diphenyl oxide disulfonate (Dowfax 3B2 ® from Dow Chemical Company), 30 grams of a 47% solution of sodium silicate with a $SiO_2/Na_2$) ratio of 2.40 (RU ® Sodium Silicate from PQ Corporation) and 10 grams of a 50% solution of aqueous potassium hydroxide was stirred in a 250 milliliter beaker, forming a clear solution. A slurry was formed by adding 48 grams of granulated sodium nitrilotriacetate to the solution. The granulated nitrilotriacetate was produced by agglomerating trisodium nitrilotriacetate with aqueous sulfuric acid and drying. The slurry was mixed for approximately 2 minutes to achieve uniformity and 10 grams of sodium carbonate were then added. This final slurry was mixed for approximately 5 minutes, after which it was poured into a mold. The slurry solidified over a period of a few hours, producing a block that was sufficiently solid to be removed from the mold. The surface of the block was dry and did not yield to attempts to deform it with thumb pressure.

EXAMPLE V

A mixture of 8 grams of deionized water, 2 grams of a low foam anionic surfactant, alkylated diphenyl oxide disulfonate (Dowfax 3B2 ® from Dow Chemical Company), 20 grams of a 47% solution of sodium silicate with a $SiO_2/Na_2O$ ratio of 2.40 (RU ® Sodium Silicate from PQ Corporation) and 10 grams of a 50% solution of aqueous potassium hydroxide was stirred in a 250 milliliter beaker, forming a clear solution. A slurry was formed by adding 40 grams of trisodium nitrilotriacetate monohydrate powder (NTA from Monsanto Company) to the solution. The slurry was stirred as 5 grams of 98% sulfuric acid were added over a period of approximately 5 minutes. The acid feed rate was selected based upon the ability of the agitator to disperse localized concentrations of acid to maintain a constant temperature and to prevent localized boiling caused by the heat of neutralization at the point of acid addition. Following the acid addition, the slurry was mixed for approximately 2 minutes to achieve uniformity and 15 grams of sodium carbonate were then added. This final slurry was mixed for approximately 5 minutes, after which it was poured into a mold. The slurry solidified over a period of a few hours, producing a block that was sufficiently solid to be removed from the mold. The surface of the block was dry and did not yield to attempts to deform it with thumb pressure.

It will be apparent from the examples that many other variations and modifications may be made in the compositions and processes described without departing from the concept and spirit of the invention. Accordingly, it should be understood that the description and examples are illustrative only and are not intended to limit the scope of the invention.

We claim:

1. A phosphate-free, solid, block detergent comprising:

a. from about 5% to about 60% by weight of the formulation of an alkali metal salt of nitrilotriacetic acid;

b. from 0.1% to about 10% by weight of the formulation of an acid selected from the group consisting of sulfuric acid, nitric acid, acetic acid and formic acid;

c. from about 5% to about 40% by weight of the formulation of a first alkali metal containing compound selected from the group consisting of alkali metal hydroxides, alkali metal silicates and mixtures of alkali metal hydroxides and silicates, wherein when the alkali metal containing compound is an alkali metal hydroxide or a mixture containing an alkali metal hydroxide, the alkali metal containing compound must include from about 0.1% to about 20% by weight of the formulation potassium hydroxide; and d. from about 5% to about 25% by weight of the formulation of a second alkali metal containing compound selected from the group consisting of alkali metal carbonates, alkali metal sulfates and mixtures of alkali metal carbonates and alkali metal sulfates.

2. The phosphate-free, solid, block detergent of claim 1 wherein the alkali metal salt of nitrilotriacetic acid is from about 25% to about 50% by weight of the formulation.

3. The phosphate-free, solid, block detergent of claim 2 wherein the alkali metal salt of nitrilotriacetic acid is from about 35% to about 50% by weight of the formulation.

4. The phosphate-free, solid, block detergent of claim 1 wherein the alkali metal salt of nitrilotriacetic acid is trisodium nitrilotriacetate monohydrate.

5. The phosphate-free, solid, block detergent of claim 1 wherein the acid is from about 2% to about 8% by weight of the formulation.

6. The phosphate-free, solid, block detergent of claim 5 wherein the acid is from about 3% to about 6% by weight of the formulation.

7. The phosphate-free, solid, block detergent of claim 1 wherein the acid is sulfuric acid.

8. The phosphate-free, solid, block detergent of claim 1 wherein the first alkali metal compound is from about 15% to about 30% by weight of the formulation.

9. The phosphate-free, solid, block detergent of claim 8 wherein the first alkali metal compound must include from about 3% to about 8% by weight of the formulation potassium hydroxide.

10. The phosphate-free, solid, block detergent of claim 1 wherein the first alkali metal compound is selected from the group consisting of alkali metal hydroxides and mixtures of alkali metal hydroxides and alkali metal silicates.

11. The phosphate-free, solid, block detergent of claim 10 wherein the first alkali metal compound is sodium hydroxide.

12. The phosphate-free, solid, block detergent of claim 1 wherein the first alkali metal compound must include from about 3% to about 8% by weight of the formulation potassium hydroxide.

13. The phosphate-free, solid, block detergent of claim 1 wherein the second alkali metal compound is from about 10% to about 20% by weight of the formulation.

14. The phosphate-free, solid, block detergent of claim 1 wherein the second alkali metal compound is sodium carbonate.

15. The phosphate-free, solid, block detergent of claim 1 wherein the second alkali metal compound is sodium sulfate.

16. The phosphate-free, solid, block detergent of claim 1 comprising:

a. from about 35% to about 50% by weight of the formulation of an alkali metal salt of nitrilotriacetic acid;

b. from about 3% to about 6% by weight of the formulation of an acid selected from the group consisting of sulfuric acid, nitric acid, acetic acid and formic acid;

c. from about 15% to about 30% by weight of the formulation of a first alkali metal containing compound selected from the group consisting of alkali metal hydroxides, alkali metal silicates and mixtures of alkali metal hydroxides and silicates, wherein when the alkali metal containing compound is an alkali metal hydroxide or a mixture containing an alkali metal hydroxide, the alkali metal containing compound must include from about 3% to about 8% by weight of the formulation potassium hydroxide; and d. from about 10% to about 20% by weight of the formulation of a second alkali metal containing compound selected from the group consisting of alkali metal carbonates, alkali metal sulfates and mixtures of alkali metal carbonates and alkali metal sulfates.

17. The phosphate-free, solid, block detergent of claim 1 comprising:

a. from about 35% to about 50% by weight of the formulation trisodium nitrilotriacetate monohydrate;

b. from about 3% to about 6% by weight of the formulation sulfuric acid;

c. from about 15% to about 30% by weight of the formulation of a mixture of sodium hydroxide and from about 3% to about 8% by weight of the formulation potassium hydroxide; and d. from about 10% to about 20% by weight of the formulation of sodium carbonate.

18. The phosphate-free, solid, block detergent of claim 1 comprising:

a. from about 35% to about 50% by weight of the formulation trisodium nitrilotriacetate monohydrate;

b. from about 3% to about 6% by weight of the formulation sulfuric acid;

c. from about 15% to about 30% by weight of the formulation of sodium silicate; and d. from about 10% to about 20% by weight of the formulation of sodium carbonate.

19. A process for producing a phosphate-free solid, block detergent comprising the steps of:

a. preparing an aqueous alkaline solution containing from about 5% to about 40% by weight of the formulation of a first alkali metal containing compound selected from the group consisting of alkali metal hydroxides, alkali metal silicates and mixtures of alkali metal hydroxides and silicates, wherein, when the aqueous alkaline solution contains alkali metal hydroxides, the alkali metal hydroxides must include sufficient potassium hydroxide to constitute from about 0.1% to about 20% by weight of the formulation;

b. mixing from about 5% to about 60% by weight of the formulation of an alkali metal salt of nitrilotriacetic acid into the aqueous alkaline solution to form a slurry;

c. adding from 0.1% to about 10% by weight of the formulation of an acid selected from the group consisting of sulfuric acid nitric acid, acetic acid and formic acid to the slurry;

d. mixing from about 5% to about 25% by weight of the formulation of a second alkali metal containing compound selected from the group consisting of alkali metal sulfates, alkali metal carbonates and mixtures of alkali metal sulfates and alkali metal carbonates into the slurry; and e. curing the slurry.

20. The process of claim 19 in which the aqueous alkaline solution contains from about 15% to about 30% by weight of the formulation of the first alkali metal containing compound.

21. The process of claim 19 in which the first alkali metal compound in the aqueous alkaline solution is selected from the group consisting of alkali metal hydroxides and mixtures of alkali metal hydroxides and silicates.

22. The process of claim 21 in which the first alkali metal compound in the aqueous alkaline solution is sodium hydroxide.

23. The process of claim 19 in which, when the aqueous alkaline solution contains alkali metal hydroxides, the alkali metal hydroxides must include sufficient potassium hydroxide to constitute from about 3% to about 8% of the weight of the formulation.

24. The process of claim 19 which includes mixing from about 25% to about 50% by weight of the formulation of an alkali metal salt of nitrilotriacetic acid into the aqueous alkaline solution to form a slurry.

25. The process of claim 24 which includes mixing from about 35% to about 50% by weight of the formulation of an alkali metal salt of nitrilotriacetic acid into the aqueous alkaline solution to form a slurry.

26. The process of claim 19 in which the alkali metal salt of nitrilotriacetic acid is trisodium nitrilotriacetate monohydrate.

27. The process of claim 19 which includes adding from about 2% to about 8% by weight of the formulation of the acid to the slurry.

28. The process of claim 27 which includes adding from about 3% to about 6% by weight of the formulation of the acid to the slurry.

29. The process of claim 19 in which the acid is sulfuric acid.

30. The process of claim 19 which includes mixing from about 10% to about 20% by weight of the formulation of the second alkali metal containing compound into the slurry.

31. The process of claim 19 in which the second alkali metal containing compound is sodium carbonate.

32. The process of claim 19 which includes:

a. preparing an aqueous alkaline solution containing from about 15% to about 30% by weight of the formulation of a first alkali metal containing compound selected from the group consisting of alkali metal hydroxides, alkali metal silicates and mixtures of alkali metal hydroxides and silicates, wherein, when the aqueous alkaline solution contains alkali metal hydroxides, the alkali metal hydroxides must include sufficient potassium hydroxide to constitute from about 3% to about 8% by weight of the formulation;

b. mixing from about 35% to about 50% by weight of the formulation of trisodium nitrilotriacetate monohydrate into the aqueous alkaline solution to form a slurry;

c. adding from about 3% to about 6% by weight of the formulation of an acid selected from the group consisting of sulfuric acid, nitric acid, acetic acid and formic acid to the slurry;

d. mixing from about 10% to about 20% by weight of the formulation of a second alkali metal containing compound selected from the group consisting of alkali metal sulfates, alkali metal carbonates and mixtures of alkali metal sulfates and alkali metal carbonates into the slurry; and e. curing the slurry.

33. The process of claim 32 which includes: preparing an aqueous alkaline solution containing from about 15% to about 30% by weight of the formulation of an alkali metal hydroxides which must include sufficient potassium hydroxide to constitute from about 3% to about 8% by weight of the formulation;

b. mixing from about 35% to about 50% by weight of the formulation of trisodium nitrilotriacetate monohydrate into the aqueous alkaline solution to form a slurry;

c. adding from about 3% to about 6% by weight of the formulation of sulfuric acid to the slurry;

d. mixing from about 10% to about 20% by weight of the formulation of sodium carbonate into the slurry; and e. curing the slurry.

34. A process for producing a phosphate-free solid, block detergent comprising the steps of:

a. preparing an aqueous alkaline solution containing from about 5% to about 40% by weight of the formulation of a first alkali metal containing compound selected from the group consisting of alkali metal hydroxides, alkali metal silicates and mixtures of alkali metal hydroxides and silicates, wherein, when the aqueous alkaline solution contains alkali metal hydroxides, the alkali metal hydroxides must include sufficient potassium hydroxide to constitute from about 0.1% to about 20% by weight of the formulation;

b. mixing from about 5% to about 60% by weight of the formulation of a granular, alkali metal salt of nitrilotriacetic acid treated with an aqueous solution of 35%-60% by weight of sulfuric acid into the aqueous alkaline solution to form a slurry;

c. mixing from about 5% to about 25% by weight of the formulation of a second alkali metal containing compound selected from the group consisting of alkali metal sulfates, alkali metal carbonates and mixtures of alkali metal sulfates and alkali metal carbonates into the slurry; and d. curing the slurry.

* * * * *